US009682295B1

(12) United States Patent
Dawson et al.

(10) Patent No.: US 9,682,295 B1
(45) Date of Patent: Jun. 20, 2017

(54) MULTIPLE-MATERIAL GOLF CLUB HEAD WITH SCARF JOINT

(71) Applicant: CALLAWAY GOLF COMPANY, Carlsbad, CA (US)

(72) Inventors: Patrick Dawson, San Diego, CA (US); William C. Watson, Temecula, CA (US); Brandon D. DeMille, Carlsbad, CA (US); Bradley C. Rice, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 15/062,698

(22) Filed: Mar. 7, 2016

Related U.S. Application Data

(60) Provisional application No. 62/280,077, filed on Jan. 18, 2016.

(51) Int. Cl.
*A63B 53/04* (2015.01)

(52) U.S. Cl.
CPC .. *A63B 53/0466* (2013.01); *A63B 2053/0408* (2013.01)

(58) Field of Classification Search
CPC ..... A63B 53/0466; A63B 2053/0408
USPC ..... 473/324–350, 287–292
See application file for complete search history.

(56) References Cited

U.S. PATENT DOCUMENTS 4,907,383 A * 3/1990 Winter, IV ..... E04C 2/296 52/309.9
5,163,682 A * 11/1992 Schmidt ..... A63B 53/04 473/332
5,318,300 A * 6/1994 Schmidt ..... A63B 53/04 473/305
5,474,296 A * 12/1995 Schmidt ..... A63B 53/04 473/346
5,830,084 A * 11/1998 Kosmatka ..... A63B 53/04 473/324
5,971,868 A * 10/1999 Kosmatka ..... A63B 53/04 473/324
6,007,432 A * 12/1999 Kosmatka ..... A63B 53/04 473/324
6,338,683 B1 * 1/2002 Kosmatka ..... A63B 53/04 473/329
6,354,962 B1 * 3/2002 Galloway ..... A63B 53/02 473/342
6,368,234 B1 * 4/2002 Galloway ..... B21J 5/00 473/324
6,398,666 B1 * 6/2002 Evans ..... A63B 53/02 473/345

(Continued)

*Primary Examiner* — Sebastiano Passaniti
(74) *Attorney, Agent, or Firm* — Rebecca Hanovice; Michael Catania; Sonia Lari

(57) ABSTRACT

A multiple-material golf club head with an improved scarf joint between the crown and the body is disclosed herein. The golf club preferably is a driver that has a metal body comprising a striking face, a sole, a return portion, a front flange, and a rear flange, and a composite crown having a scarf joint region, a transitional thickness region directly behind the scarf joint region, and a constant thickness region directly behind the transitional thickness region. The thickness distribution along the crown, in combination with the tapered edge of the scarf joint and its intersection with the front flange, greatly reduces the stress placed on critical portions of the club head and improves overall golf club head durability.

20 Claims, 7 Drawing Sheets

(56) References Cited

U.S. PATENT DOCUMENTS 6,413,169 B1 * 7/2002 Kosmatka ..... A63B 53/04 473/224
6,428,426 B1 * 8/2002 Helmstetter ..... A63B 53/04 473/329
6,435,977 B1 * 8/2002 Helmstetter ..... A63B 53/02 473/290
6,435,980 B1 * 8/2002 Reyes ..... A63B 53/04 428/323
6,623,377 B2 * 9/2003 Evans ..... A63B 53/02 473/329
6,623,378 B2 9/2003 Beach et al.
6,969,326 B2 11/2005 De Shiell et al.
6,997,821 B2 * 2/2006 Galloway ..... A63B 53/02 473/329
7,014,570 B2 * 3/2006 Evans ..... A63B 53/02 473/329
7,101,289 B2 * 9/2006 Gibbs ..... A63B 53/04 473/329
7,137,907 B2 * 11/2006 Gibbs ..... A63B 53/0466 473/329
7,144,334 B2 * 12/2006 Ehlers ..... A63B 53/04 473/329
7,163,468 B2 * 1/2007 Gibbs ..... A63B 53/0466 473/329
7,166,038 B2 * 1/2007 Williams ..... A63B 53/0466 473/329
7,169,060 B2 * 1/2007 Stevens ..... A63B 53/0466 473/329
7,258,626 B2 * 8/2007 Gibbs ..... A63B 53/04 473/329
7,278,927 B2 * 10/2007 Gibbs ..... A63B 53/0466 473/329
7,291,075 B2 * 11/2007 Williams ..... A63B 53/0466 473/329
7,306,527 B2 * 12/2007 Williams ..... A63B 53/0466 473/329
7,311,613 B2 * 12/2007 Stevens ..... A63B 53/0466 473/329
7,390,269 B2 * 6/2008 Williams ..... A63B 53/0466 473/329
7,407,448 B2 * 8/2008 Stevens ..... A63B 53/0466 473/329
7,410,428 B1 * 8/2008 Dawson ..... A63B 53/0466 473/345
7,413,519 B1 * 8/2008 Dawson ..... A63B 53/0466 473/345
7,413,520 B1 * 8/2008 Hocknell ..... A63B 53/0466 473/345
7,419,440 B2 * 9/2008 Williams ..... A63B 53/0466 473/329
7,422,528 B2 * 9/2008 Gibbs ..... A63B 53/04 473/329
7,448,960 B2 * 11/2008 Gibbs ..... A63B 53/04 473/329
7,455,598 B2 * 11/2008 Williams ..... A63B 53/0466 473/329
7,476,161 B2 * 1/2009 Williams ..... A63B 53/0466 473/329
7,494,424 B2 * 2/2009 Williams ..... A63B 53/0466 473/329
7,578,751 B2 * 8/2009 Williams ..... A63B 53/0466 473/329
7,588,501 B2 * 9/2009 Williams ..... A63B 53/0466 473/329
7,591,737 B2 * 9/2009 Gibbs ..... A63B 53/0466 473/329
7,713,140 B2 * 5/2010 Gibbs ..... A63B 53/04 473/329
8,012,041 B2 * 9/2011 Gibbs ..... A63B 53/0466 473/329
8,147,354 B2 4/2012 Hartwell et al.
8,696,489 B2 * 4/2014 Gibbs ..... A63B 53/0466 473/329
9,033,822 B1 * 5/2015 Demille ..... A63B 53/0466 473/345
9,101,809 B2 * 8/2015 Gibbs ..... A63B 53/0466
2015/0045134 A1 2/2015 Beno et al.

* cited by examiner

MULTIPLE-MATERIAL GOLF CLUB HEAD WITH SCARF JOINT

CROSS REFERENCES TO RELATED APPLICATIONS

The present application claims priority to U.S. Provisional Patent Application No. 62/280,077, filed on Jan. 18, 2016, the disclosure of which is incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a multiple material golf club head with an improved attachment region between parts of the head. More specifically, the present invention relates to a golf club head with a composite crown having a scarf joint attachment configuration with a face component of the head.

Description of the Related Art

Golf club manufacturers often combine metallic golf club head bodies with composite crowns to reduce the overall head mass and lower the clubs' center of gravity, thus improving the mass properties of such multiple material heads. The region where the crown is affixed to the body with an adhesive material is typically known as the bond joint. In prior art multiple material golf club heads, manufacturers often employ a lap joint, or "step" structure, examples of which are shown in FIGS. 1 (disclosed in U.S. Pat. No. 6,623,378) and 2 (disclosed in U.S. Pat. No. 6,969,326), at the intersection between the crown and the body. This "step"-type prior art structure, though relatively straightforward to manufacture, is problematic because it creates a high-stress area at the front of the bond joint, which means that a great deal of stress is placed on the adhesive when the golf club head impacts a golf ball. This causes the crown to separate from the body at the bond region, which becomes visible to a golfer after repeated use and often leads to permanent damage to the club. The prior art discloses other types of bond region structures, including a basic scarf joint shown in FIG. 3 (disclosed in U.S. Patent Application Publication Number 2015/0045134), but this structure is not optimized to address the significant stresses placed on the bond region and other parts of the golf club head when the head repeatedly impacts golf balls.

Therefore, there is a need for an improved bond region structure that can be manufactured efficiently and that minimizes the significant stresses of impact that cause separation of the crown from the body.

BRIEF SUMMARY OF THE INVENTION

One aspect of the present invention is a golf club head comprising a body having a flange and a composite crown having a tapered, full or partial scarf joint attachment region.

Another aspect of the present invention is a golf club head comprising a hollow body comprising a hosel, a striking face, a face extension, a bond flange extending away from the face extension, a sole, a rear flange extending away from the sole at an angle less than 90°, and an upper opening, and a composite crown, wherein the composite crown is affixed to the body with an adhesive to close the upper opening, wherein the bond flange comprises a front region and a back region, wherein the crown comprises a scarf region with a first average thickness, a transition region with a second average thickness, and a rear region with a first constant thickness, wherein the scarf region comprises a tapered edge, wherein the second average thickness is greater than the first average thickness, and wherein the second average thickness is greater than the first constant thickness. In some embodiments, the front region may not comprise any convex or concave curvature. In others, the bond flange may have a maximum width of no less than 0.100 inch and no more than 0.400 inch, and more preferably a maximum width of approximately 0.300 inch. In some embodiments, the bond flange may have a variable width, while in others the bond flange may have a constant width.

In some embodiments, the back region may have a second constant thickness, which may be greater than the first constant thickness. In a further embodiment, the difference in thickness between the second constant thickness and the first constant thickness may be at least 0.010 inch, and more preferably may be approximately 0.015 inch. In some embodiments, the transition region may have a width of at least 0.400 inch, and more preferably at least 0.500 inch. In other embodiments, the first constant thickness may be no less than 0.020 inch and no more than 0.040 inch, more preferably no less than 0.022 inch and no more than 0.035 inch, and even more preferably approximately 0.022 inch. In some embodiments, the crown may be composed of a compression-molded composite material, and in others, the rear flange may comprise a convex curvature.

Yet another aspect of the present invention is a driver-type golf club head comprising a hollow metal body comprising a hosel, a striking face, a face extension, a bond flange extending away from the face extension, a sole, a rear flange extending away from an edge of the sole at an angle less than 90°, and an upper opening, and a composite crown, wherein the crown is affixed to the body with an adhesive to close the upper opening, wherein the crown comprises a scarf region with a first average thickness, a transition region with a second average thickness, and a rear region with a first constant thickness, wherein the second average thickness is greater than the first average thickness, wherein the second average thickness is greater than the first constant thickness, wherein the first constant thickness is no less than 0.020 inch and no more than 0.040 inch, wherein the scarf region comprises a tapered edge, wherein the scarf region increases in thickness from the tapered edge to the transition region, wherein the transition region comprises a maximum thickness area proximate the scarf region, and wherein the transition region has a width of at least 0.500 inch.

In some embodiments, the crown may be compression molded from SMC material. In others, the bond flange may comprise a region having a second constant thickness, which may be at least 0.015 inch greater than the first constant thickness. In some embodiments, the crown may cover the entirety of the rear flange, and in others, the adhesive may have a thickness of no more than 0.010 inch.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
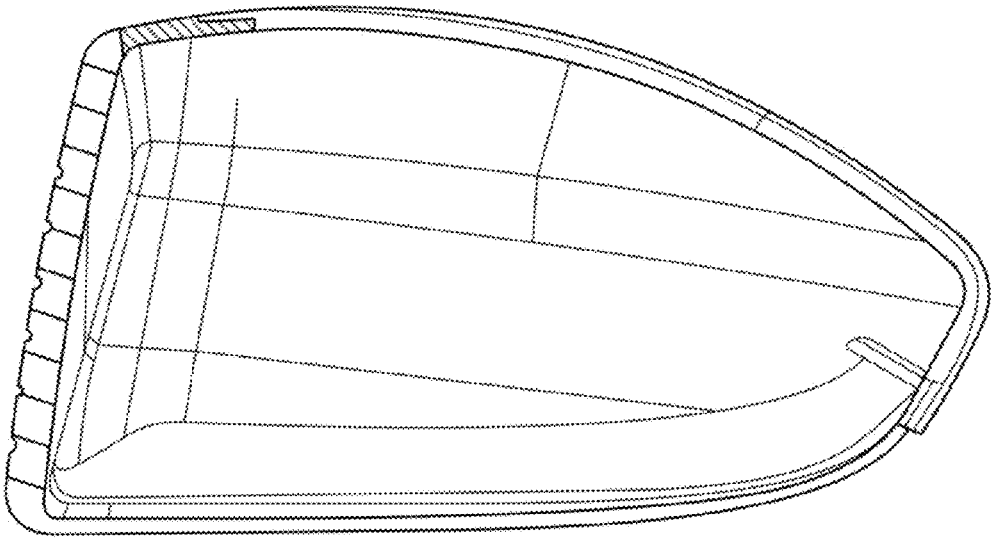
FIG. 1 (Prior Art)
FIG. 1 is a cross-sectional view of a prior art golf club head.
Figure 2:
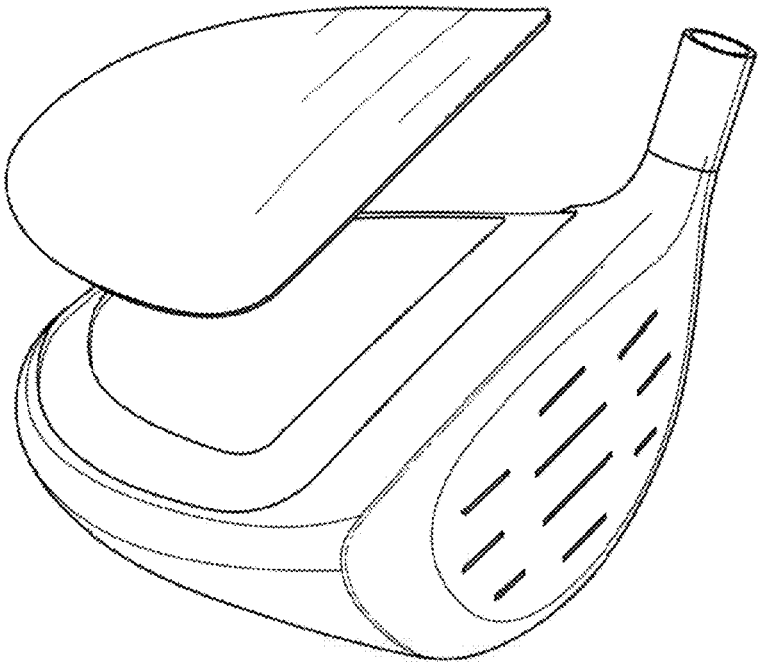
FIG. 2 (Prior Art)
FIG. 2 is an exploded and partial cross-sectional view of a prior art golf club head.
Figure 3:
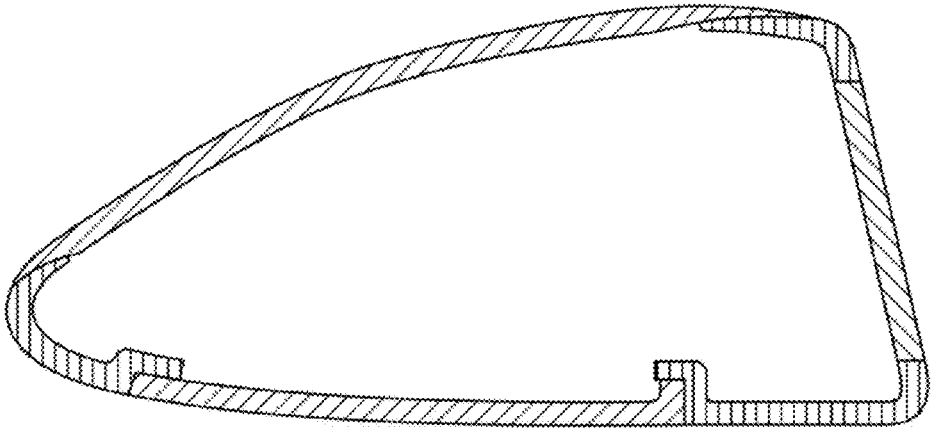
FIG. 3 (Prior Art)
FIG. 3 is a cross-sectional view of a prior art golf club head.
Figure 4:
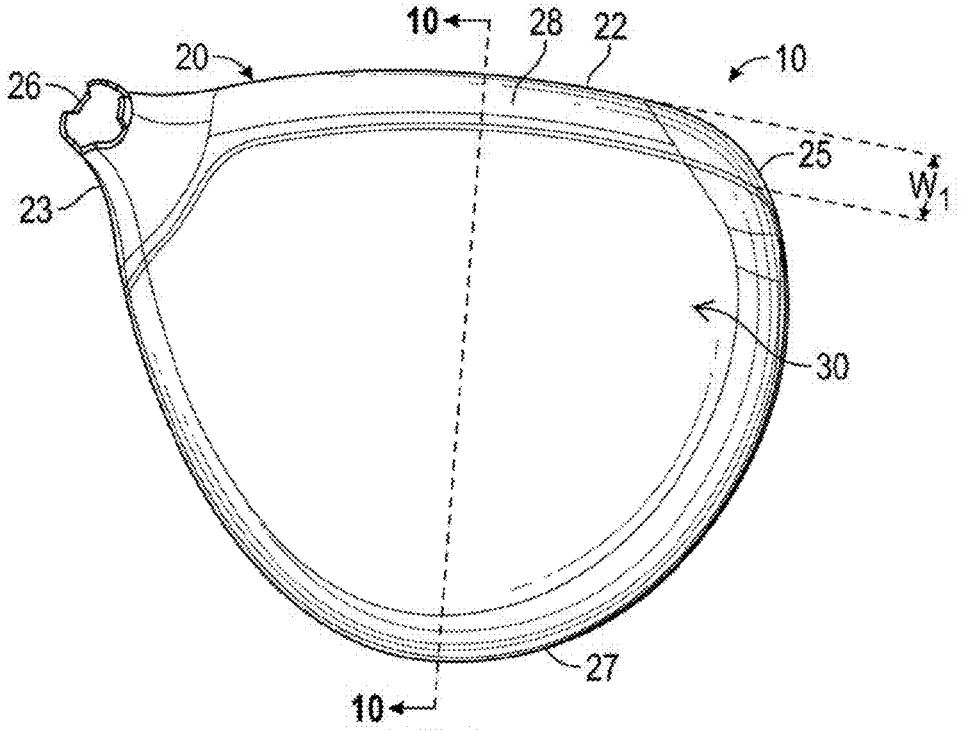
FIG. 4 is a top elevational view of a golf club head according to the present invention.

The present invention introduces a solution to the problems set forth above by providing a crown with an improved scarf joint construction and thickness distribution in combination with a golf club head having improved support flanges.

A preferred embodiment of the present invention is shown in FIGS. 4-12. In this embodiment, the golf club head 10 comprises a body 20 having a striking face 22, a heel 23, a sole 24, a toe 25, a hosel 26, a rear side 27, a face extension 28 extending rearwards away from the striking face 22, a bond flange 40 extending rearwards away from the face extension 28, an upper opening, and a rear flange 50 extending away from the rear side 27 of the sole 24 towards the striking face 22 at an angle $\alpha$ that is preferably less than 90°. The golf club head 10 also comprises a crown 30 that is permanently bonded to the body 20 with an adhesive to close the upper opening and preferably is composed of a material such as triax composite, SMC, prepreg plies, or any of the compositions disclosed in U.S. Pat. No. 9,033,822, the disclosure of which is incorporated by reference in its entirety herein. The adhesive 15 should have a thickness of no more than 0.010 inch.

Figure 5:
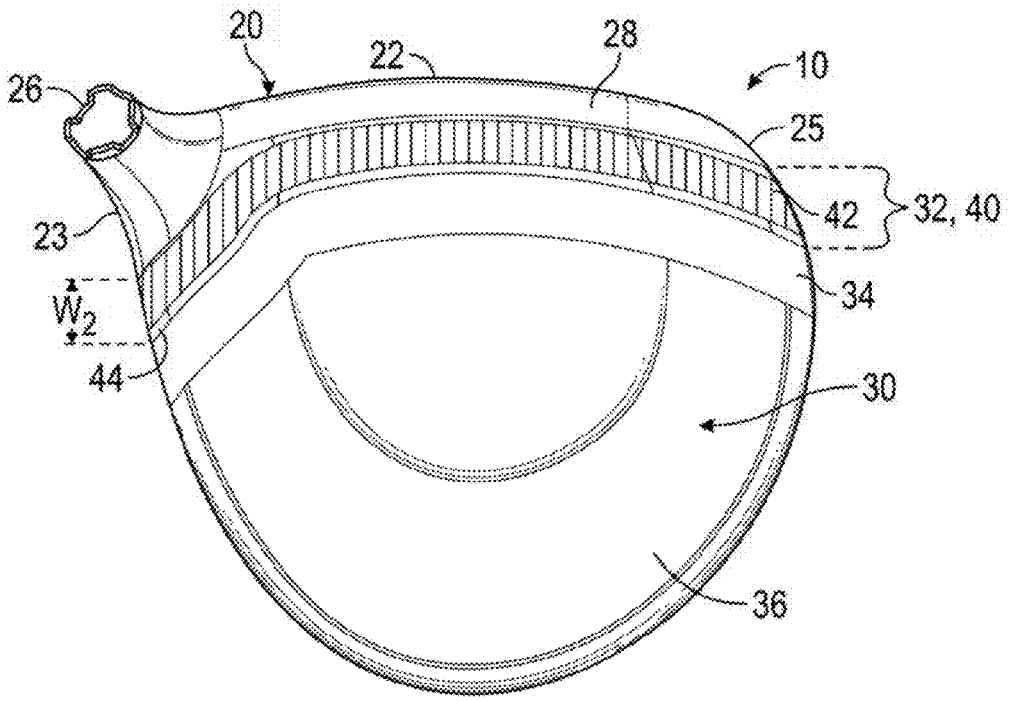
FIG. 5 is a top elevational view of the golf club head shown in FIG. 4 with a forward-most region of the bond flange highlighted.
Figure 6:
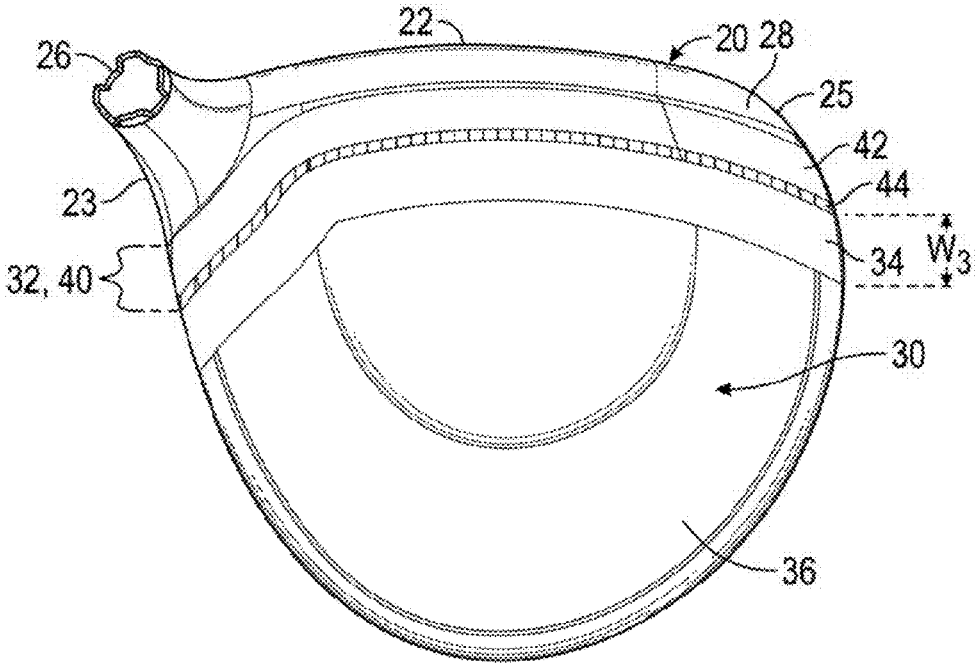
FIG. 6 is a top elevational view of the golf club head shown in FIG. 4 with the rear edge of the bond flange highlighted.
Figure 7:
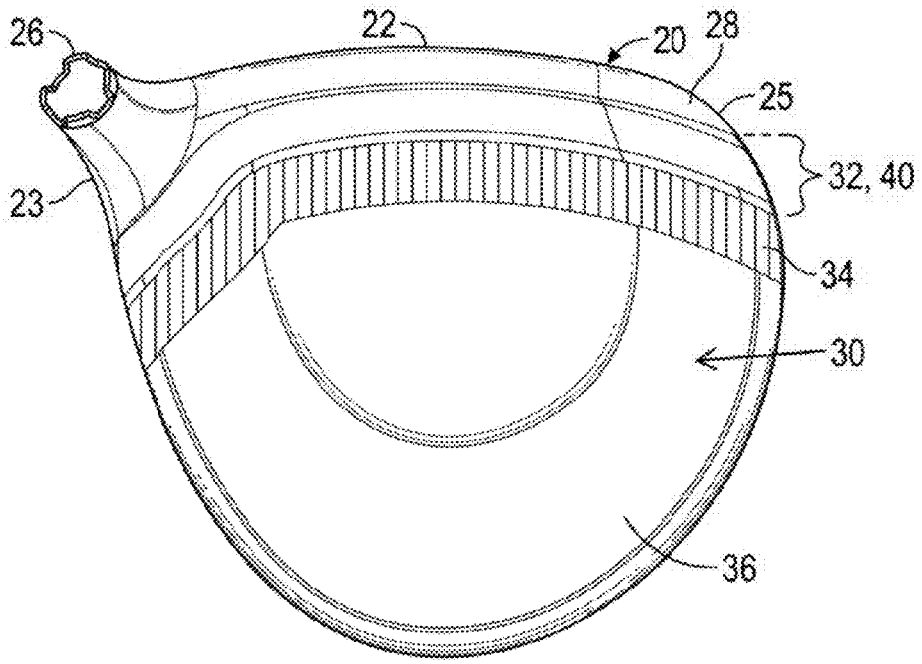
FIG. 7 is a top elevational view of the golf club head shown in FIG. 4 with the transition surface of the crown highlighted.
Figure 8:
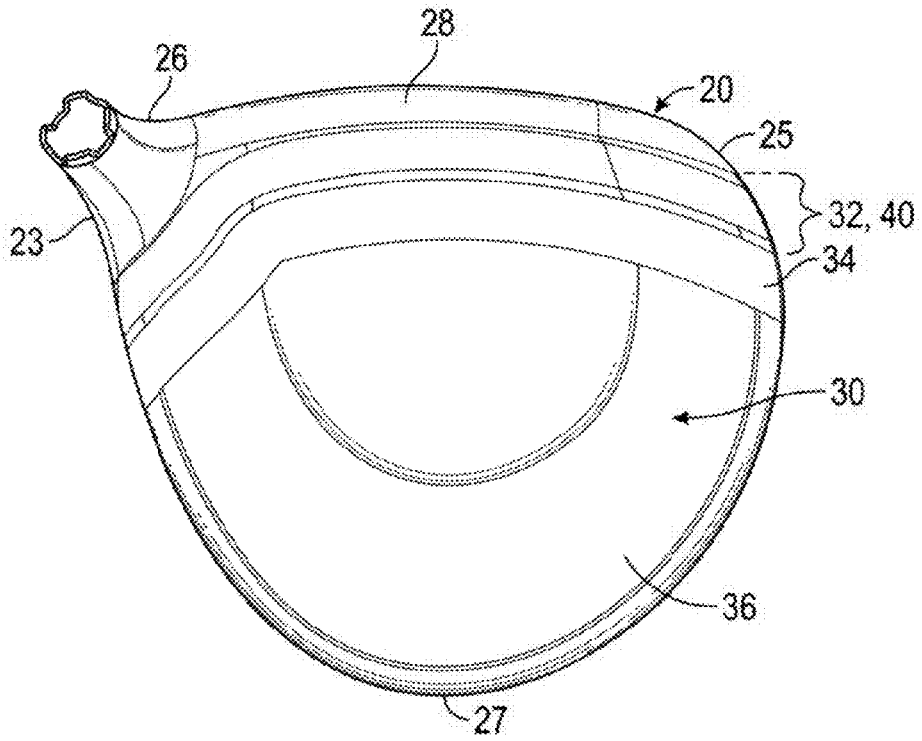
FIG. 8 is a top elevational view of the golf club head shown in FIG. 4 with the constant thickness section of the crown highlighted.
Figure 9:
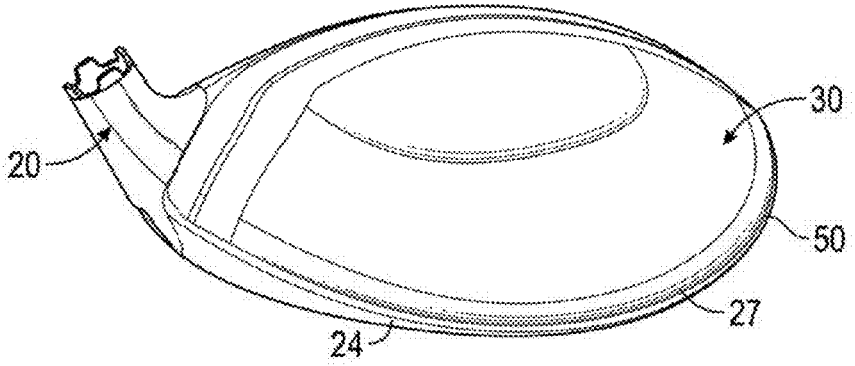
FIG. 9 is a rear perspective view of the golf club head shown in FIG. 4 with the intersection area between the crown and the rear edge of the golf club body highlighted.

The bond flange 40 extends away from the face extension 28, which preferably has a front-to-back width $W_1$ of at least 0.200 inch, and more preferably approximately 0.400 inch. The bond flange 40 extends off of the face extension 28 and jogs around the hosel 26 at the heel side 23 to connect with the rear flange 50, which extends off of the sole 24 and frames at least a portion of the upper opening. The bond flange 40 may have a variable front-to-back width, but preferably has a constant width $W_2$ that ranges from 0.100 to 0.400 inch, and more preferably is approximately 0.300 inch. It is important that the bond flange 40 have no convex or concave curvature to avoid introducing weak points into the bond between the bond flange 40 and the crown 30 when the golf club head 10 is fully assembled. As shown in FIGS. 5 and 6, the bond flange 40 has a front region 42 and a back region 44. The front region 42 may vary in thickness, but the back region 44 preferably has a constant thickness $T_1$ to provide consistent support to the crown 30 where it contacts the body 20.

Figure 10:
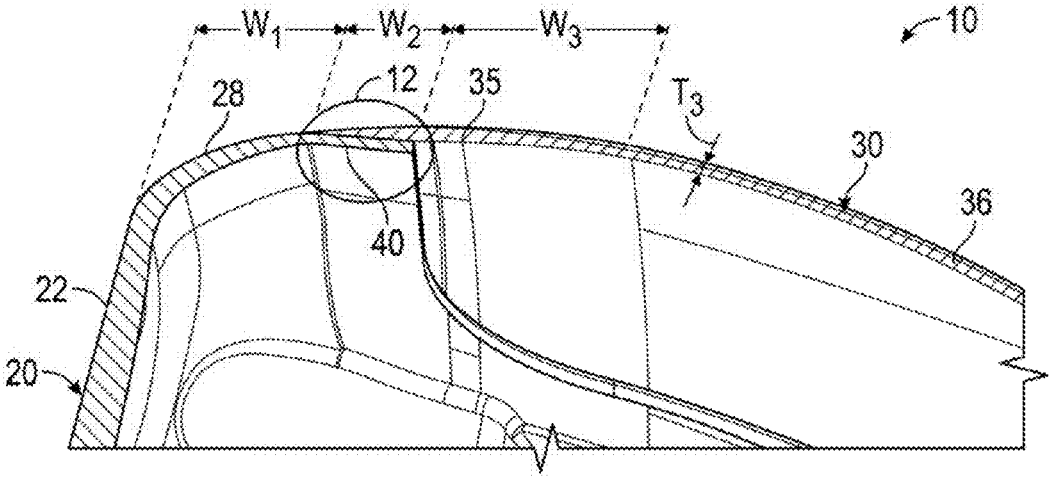
FIG. 10 is a cross-sectional view of the golf club head shown in FIG. 4 along lines 10-10.
Figure 11:
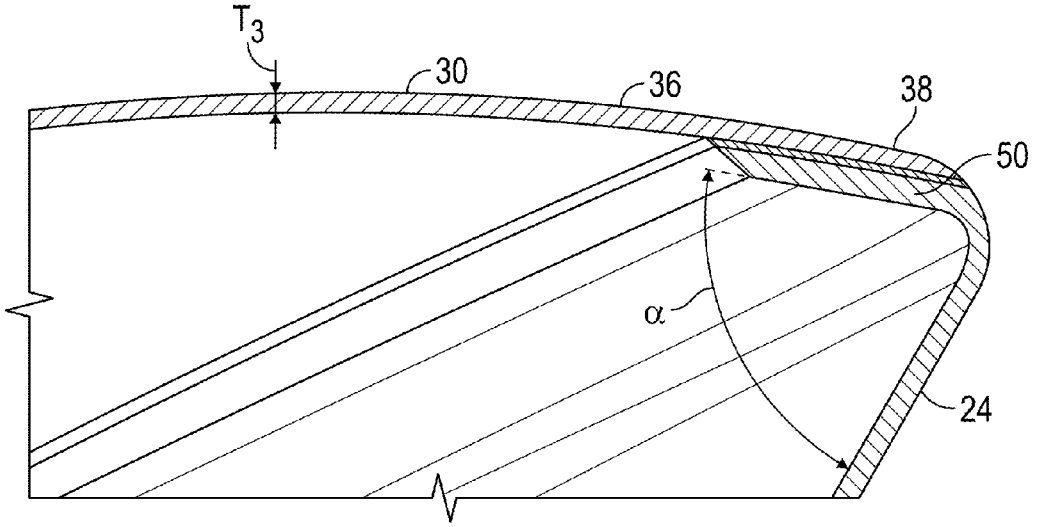
FIG. 11 is a cross-sectional view of the golf club head shown in FIG. 9 along lines 11-11.
Figure 12:
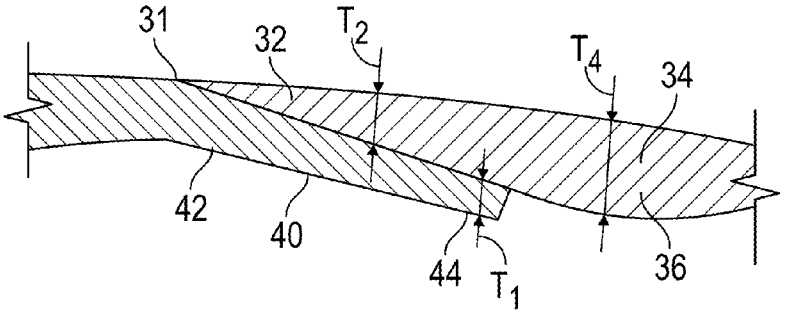
FIG. 12 is an enlarged view of the circled, cross-sectional area in FIG. 10.

As shown in the Figures, and particularly FIGS. 10 and 12, the crown 30 includes a tapered scarf region 32, which includes a sharp edge 31 where the crown 30 ends, a transition region 34 where the crown thickness increases and then decreases after achieving a maximum thickness at a midpoint 35 of the transition region 34, and a rear region 36 with a constant thickness. The transition region 34 preferably has a front-to-back width $W_3$ of at least 0.400 inch, and more preferably at least 0.500, to provide the structural support necessary to distribute stresses evenly without adding too much mass to the crown 30. The rear region 36 constitutes the remaining area of the crown 30, and preferably a majority of the area of the crown 30. The edge 38 of the rear region 36 intersects with the rear flange 50 of the body 20, which may have a convex curvature to match the curvature of the crown 30.

The scarf region 32 has an average thickness $T_2$, defined as the average thickness of points taken along the entire front-to-back width $W_2$ of the scarf region 32 (which is the same as the front-to-back width of the bond flange 40, because the scarf region 32 completely covers the bond flange 40), the rear region 36 has a constant thickness $T_3$, and the transition region 34 has an average thickness $T_4$ that is greater than both $T_2$ and $T_3$. In the preferred embodiment, the thickness $T_3$ of the rear region 36 is between 0.020 and 0.040 inch thick, and can be as thin as 0.022 inch if triax material is used to make the crown 30. If SMC is used to make the crown 30, then the rear region 36 should be at least 0.035 inch thick. In either case, the thickness $T_1$ of the back region 44 of the bond flange 40 should be at least 0.015 inch thicker than $T_3$ to provide adequate support for the crown 30 and to distribute stresses appropriately.

Figure 13:
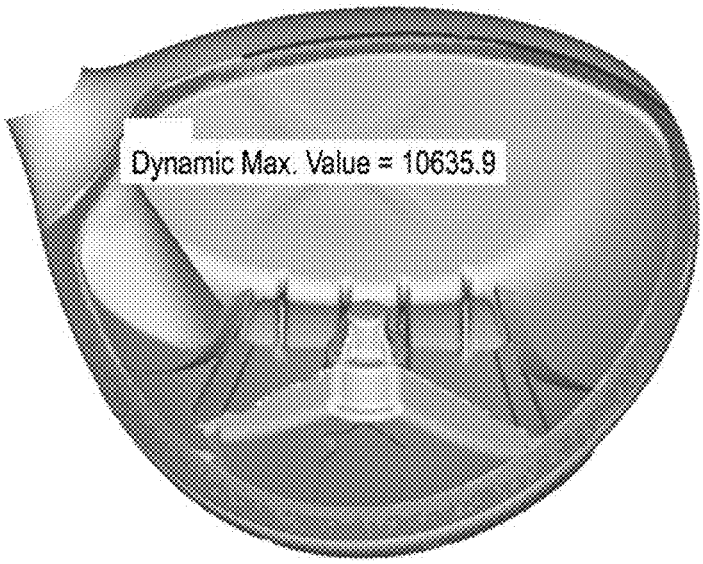
FIG. 13 is a top perspective view of a traditional golf club head without its crown portion and with stress patterns illustrated across the lap joint surface.
Figure 14:
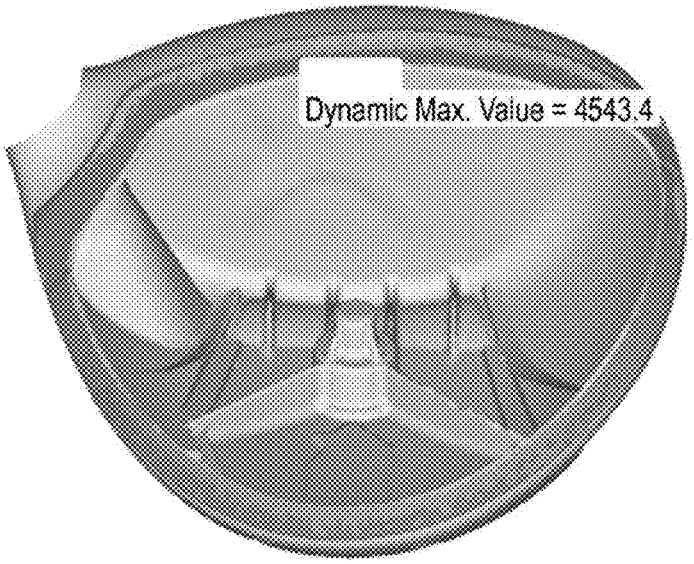
FIG. 14 is a top perspective view of the golf club head shown in FIG. 4 without its crown portion and with stress patterns illustrated across the bond flange surface.

The novel intersection of the bond flange 40 with the crown 30 of the present invention dramatically reduces the stress placed on the intersection between the body 20 and the crown 30. In fact, as shown in FIGS. 13-14, when compared with a traditional lap joint, the scarf joint configuration of the present invention reduces average stress on the bond flange 40 by more than 5000 psi.

The golf club head 10 of the present invention may be constructed to take various shapes, including traditional, square, rectangular, or triangular. In some embodiments, the golf club head 10 of the present invention may take shapes such as those disclosed in U.S. Pat. Nos. 7,163,468, 7,166,038, 7,169,060, 7,278,927, 7,291,075, 7,306,527, 7,311,613, 7,390,269, 7,407,448, 7,410,428, 7,413,520, 7,413,519, 7,419,440, 7,455,598, 7,476,161, 7,494,424, 7,578,751, 7,588,501, 7,591,737, and 7,749,096, the disclosure of each of which is incorporated by reference in its entirety herein.

The golf club head 10 of the present invention may also have variable striking face 22 thickness, such as the thickness patterns disclosed in U.S. Pat. Nos. 5,163,682, 5,318,300, 5,474,296, 5,830,084, 5,971,868, 6,007,432, 6,338,683, 6,354,962, 6,368,234, 6,398,666, 6,413,169, 6,428,426, 6,435,977, 6,623,377, 6,997,821, 7,014,570, 7,101,289, 7,137,907, 7,144,334, 7,258,626, 7,422,528, 7,448,960, 7,713,140, 8,012,041, 8,696,489, and 9,101,809, the disclosure of each of which is incorporated by reference in its entirety herein.

The mass of the club head 10 of the present invention ranges from 165 grams to 250 grams, preferably ranges from 175 grams to 230 grams, and most preferably from 190 grams to 205 grams. The crown 30 has a mass preferably ranging from 4 grams to 30 grams, more preferably from 15 grams to 25 grams, and most preferably 20 grams.

The golf club head 10 of the present invention preferably has a volume that ranges from 290 cubic centimeters to 600 cubic centimeters, and more preferably ranges from 330 cubic centimeters to 510 cubic centimeters, even more preferably 350 cubic centimeters to 495 cubic centimeters, and most preferably 415 cubic centimeters or 470 cubic centimeters.

The center of gravity and the moment of inertia of a golf club head 10 of the present invention are preferably measured using a test frame ($X^T$, $Y^T$, $Z^T$), and then transformed to a head frame ($X^H$, $Y^H$, $Z^H$). The center of gravity of a golf club head may be obtained using a center of gravity table having two weight scales thereon, as disclosed in U.S. Pat. No. 6,607,452, entitled High Moment Of Inertia Composite Golf Club, and hereby incorporated by reference in its entirety.

The moment of inertia, Izz, about the Z axis for the golf club head 10 of the present invention preferably ranges from 2800 g-cm$^2$ to 6000 g-cm$^2$, preferably from 3000 g-cm$^2$ to 600 g-cm$^2$, and most preferably from 5000 g-cm$^2$ to 6000 g-cm$^2$. The moment of inertia, Iyy, about the Y axis for the golf club head 10 preferably ranges from 1500 g-cm$^2$ to 5000 g-cm$^2$, preferably from 2000 g-cm$^2$ to 5000 g-cm$^2$, and most preferably from 3000 g-cm$^2$ to 4500 g-cm$^2$. The moment of inertia, Ixx, about the X axis for the golf club head 10 preferably ranges from 1500 g-cm$^2$ to 4000 g-cm$^2$, preferably from 2000 g-cm$^2$ to 3500 g-cm$^2$, and most preferably from 2500 g-cm$^2$ to 3000 g-cm$^2$.

The golf club heads 10 of the present invention preferably have coefficient of restitutions ("COR") ranging from 0.81 to 0.875, and more preferably from 0.82 to 0.84. The golf club heads 10 preferably have characteristic times ("CT") as measured under USGA conditions of 256 microseconds.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. The section titles included herein also are not intended to be limiting. Therefore, the embodiments of the invention in which an exclusive property or privilege is claimed are defined in the following appended claims.

We claim:

1. A golf club head comprising:

a hollow body comprising a hosel, a striking face, a face extension, a bond flange extending away from the face extension, a sole, a rear flange extending away from the sole at an angle less than 90°, and an upper opening; and a composite crown, wherein the composite crown is affixed to the body with an adhesive to close the upper opening, wherein the face extension comprises a first front-to-back width, wherein the bond flange comprises a front region, a back region, and a second front-to-back width, wherein the front region does not comprise any convex or concave curvature, wherein the crown comprises a scarf region with a first average thickness, a transition region with a second average thickness, and a rear region with a first constant thickness, wherein the scarf region comprises a tapered edge, wherein the transition region comprises a rounded, convex curvature and a third front-to-back width, wherein each of the first and third front-to-back widths is greater than the second front-to-back width, wherein the second average thickness is greater than the first average thickness, wherein the second average thickness is greater than the first constant thickness, wherein the back region has a second constant thickness, and wherein the second constant thickness is greater than the first constant thickness.

2. The golf club head of claim 1, wherein the bond flange has a maximum width of no less than 0.100 inch and no more than 0.400 inch.

3. The golf club head of claim 2, wherein the bond flange has a maximum width of approximately 0.300 inch.

4. The golf club head of claim 2, wherein the bond flange has a constant width.

5. The golf club head of claim 1 wherein the difference in thickness between the second constant thickness and the first constant thickness is at least 0.010 inch.

6. The golf club head of claim 5, wherein the difference in thickness between the second constant thickness and the first constant thickness is approximately 0.015 inch.

7. The golf club head of claim 1, wherein the transition region has a width of at least 0.400 inch.

8. The golf club head of claim 7, wherein the width of the transition region is at least 0.500 inch.

9. The golf club head of claim 1, wherein the first constant thickness is no less than 0.020 inch and no more than 0.040 inch.

10. The golf club head of claim 9, wherein the first constant thickness is no less than 0.022 inch and no more than 0.035 inch.

11. The golf club head of claim 10, wherein the first constant thickness is approximately 0.022 inch.

12. The golf club head of claim 1, wherein the crown is composed of a compression-molded composite material.

13. The golf club head of claim 1, wherein the rear flange comprises a convex curvature.

14. A driver-type golf club head comprising:

a hollow metal body comprising a hosel, a striking face, a face extension, a bond flange extending away from the face extension, a sole, a rear flange extending away from an edge of the sole at an angle less than 90°, and an upper opening; and a composite crown, wherein the face extension has a front-to-back width of at least 0.200 inch, wherein the bond flange has a front-to-back width of 0.100 to 0.400 inch and does not comprise any convex or concave curvature, wherein the crown is affixed to the body with an adhesive to close the upper opening, wherein the crown covers the entirety of the rear flange, wherein the crown comprises a scarf region with a first average thickness, a transition region with a second average thickness, and a rear region with a first constant thickness, wherein the transition region comprises a smoothly rounded bulge, wherein the second average thickness is greater than the first average thickness, wherein the second average thickness is greater than the first constant thickness, wherein the first constant thickness is no less than 0.020 inch and no more than 0.040 inch, wherein the scarf region comprises a tapered edge, wherein the scarf region increases in thickness from the tapered edge to the transition region, wherein the transition region comprises a maximum thickness area proximate the scarf region, and wherein the transition region has a front-to-back width of at least 0.500 inch.

15. The driver-type golf club head of claim 14, wherein the crown is compression molded from SMC material.

16. The driver-type golf club head of claim 14, wherein the bond flange comprises a region having a second constant thickness, and wherein the second constant thickness is at least 0.015 inch greater than the first constant thickness.

17. The driver-type golf club head of claim 14, wherein the adhesive has a thickness of no more than 0.010 inch.

18. The driver-type golf club head of claim 14, wherein the face extension comprises a front-to-back width of approximately 0.400 inch, and wherein the bond flange comprises a front-to-back width of approximately 0.300 inch.

19. The driver-type golf club head of claim 14, wherein the crown comprises triax composite.

20. The driver-type golf club head of claim 19, wherein the first constant thickness is approximately 0.022 inch.

* * * * *